United States Patent [19]

Steele et al.

[11] Patent Number: 4,820,133

[45] **Date of Patent: * Apr. 11, 1989**

[54] AXIAL PISTON COMPRESSOR WITH DISCHARGE VALVING SYSTEM IN CAST HOUSING HEAD

[75] Inventors: David G. Steele, Connersville, Ind.; Duane F. Steele, Dearborn, Mich.

[73] Assignee: Ford Motor Company, Dearborn, Mich.

[ * ] Notice: The portion of the term of this patent subsequent to Dec. 13, 2005 has been disclaimed.

[21] Appl. No.: 128,311

[22] Filed: Dec. 3, 1987

[51] Int. Cl.[4] ..... F04B 1/16; F04B 1/18

[52] U.S. Cl. ..... 417/269; 417/571

[58] Field of Search ..... 417/269, 571; 92/71, 92/147

[56] References Cited

U.S. PATENT DOCUMENTS

| | | | |
|---|---|---|---|
| 3,888,604 | 6/1975 | Oshima et al. | 417/269 |
| 4,394,110 | 7/1983 | Ishizuka | 417/269 |
| 4,413,955 | 11/1983 | Kato et al. | 417/270 |
| 4,507,059 | 3/1985 | Kobayashi et al. | 417/270 |
| 4,717,313 | 1/1988 | Ohno et al. | 417/269 |

FOREIGN PATENT DOCUMENTS

| | | | |
|---|---|---|---|
| 22037 | 8/1972 | Japan | 417/269 |
| 110783 | 7/1982 | Japan | 417/269 |

*Primary Examiner*—William L. Freeh

*Attorney, Agent, or Firm*—Donald J. Harrington; Keith L. Zerschling

[57] ABSTRACT

A valve assembly for a swashplate air conditioning compressor comprising a valve plate, discharge valve reeds on one side of the plate and inlet valve reed on the other side of the valve plate, a seal plate located adjacent the outlet valve reeds for sealing high pressure regions from low pressure regions, and retainers securing the valve plate, the valve reeds and the seal plate together in a subassembly, one subassembly being substantially interchangeable with a second subassembly at the opposite axial end of the compressor.

6 Claims, 7 Drawing Sheets

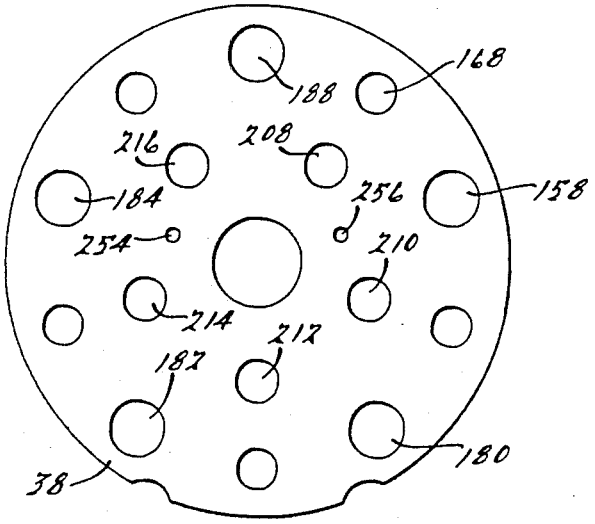
FIG. 7.
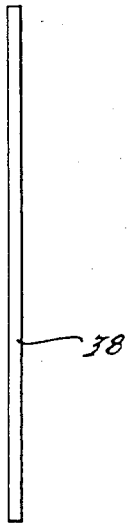
FIG. 8.
FIG. 9.
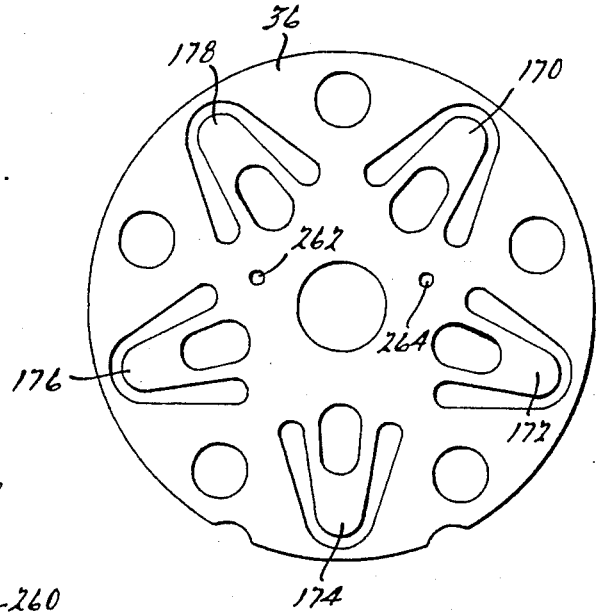
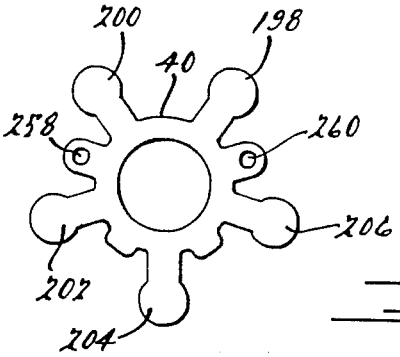
FIG. 10.

AXIAL PISTON COMPRESSOR WITH DISCHARGE VALVING SYSTEM IN CAST HOUSING HEAD

BACKGROUND OF THE INVENTION

The improvement of our invention comprises a valve arrangement for use in an automotive air conditioning compressor. Such compressors may comprise a cast cylinder housing in which are formed axial cylinders that receive multiple axially movable pistons operated by a swashplate. The swashplate in turn is driven by the vehicle engine. Examples of such prior art constructions are shown in U.S. Pat. Nos. 3,955,899 and 3,864,801.

Such swashplate compressors normally comprise end plates located on either axial end of the cylinders, which are formed in a housing arranged in multiple parts. The housing parts and the end plates are bolted together in end-to-end relationship. The end plates form valve cavities and valve elements control flow of refrigerant fluid to each of the cylinders as the pistons for the respective cylinders are stroked during an intake stroke portion of the refrigeration cycle. Other valve elements are used to control the flow of fluid from the end of each of the cylinders during the compression stroke of each piston for the respective cylinders.

The manufacture and the assembly of the end plates and the valve structure present complex machining and assembly problems, and the space occupied by the end plates and the associated valve parts creates packaging problems for air conditioning compressors in vehicle engine compartments.

BRIEF DESCRIPTION OF THE INVENTION

It is an object of our invention to simplify the compressor design by providing a built-in cylinder housing head that forms an integral part of the compressor housing and by providing inlet flow passages and high pressure discharge passages for the refrigerant that are cast in the housing head. The cylinder bodies are separate from and are enclosed within the housings and are arranged in juxtaposed relationship with respect to the ends of the housing heads in which the cast passages are formed.

We have provided a subassembly of intake and exhaust valve elements adjacent each housing head. This subassembly includes a valve plate adjacent the end of a cylinder block, a discharge valve disc defining reed valves that establish a controlled flow exit path for the high pressure fluid from the cylinders and an intake valve disc having reed valves that establish a controlled flow intake of refrigerant fluid into the cylinders. The valve plate and the valve discs are ported to provide axial flow of fluid, both high pressure fluid and low pressure fluid, from one end of the cylinders to the other without the necessity for using external passage structure. These ports communicate with axial passages formed in the cylinder blocks themselves.

The housing head provides a backup for limiting the deflection of the discharge reed valves. A seal disc, located between the discharge valve disc and the housing head, seals the high pressure regions of the compressor from the low pressure regions and it also secures the discharge valve disc firmly against the valve plate at a radially inward location so that the base or radially inward locations of the discharge reed valves are not unduly stressed during operation.

The valve assembly at one axial end of the compressor is interchangeable with the valve assembly at the other end thereby making it much simpler to assemble in a high volume manufacturing operation. The valve assembly that comprises the inlet and outlet valve elements, the valve plate and the seal plate are secured together by retainer pins to form a subassembly that may be inserted during manufacture into the cylinder housing head, the latter being formed with pin openings that receive the pins thereby assuring that the valve plates are properly indexed and positioned prior to the assembly of the adjacent cylinder body. The cylinder body itself also is provided with pin openings that register with the pins of the valve assembly thereby assuring that the cylinder body is properly angularly aligned with respect to the valve assembly.

The seal disc can be embossed with a linear embossment that encircles the discharge valve disc and separates the high pressure passages from the low pressure passages.

Our improved construction reduces manufacturing costs and improves reliability while taking advantage of a reduced axial length of the finished compressor assembly.

BRIEF DESCRIPTION OF THE FIGURES OF THE DRAWINGS

FIG. 1 is a cross-sectional assembly view of a compressor and clutch assembly.

FIG. 7 is a plan view of the front of the valve plate used in the assembly.

FIG. 8 is an edge or end view of the plate of FIG. 7.

FIG. 9 is a plan view of an inlet valve reed positioned at each axial end of the cylinder blocks.

FIG. 10 is a plan view of the outlet or discharge valve reed located at each axial end of the cylinder blocks.

PARTICULAR DESCRIPTION OF THE INVENTION

Figure 1:
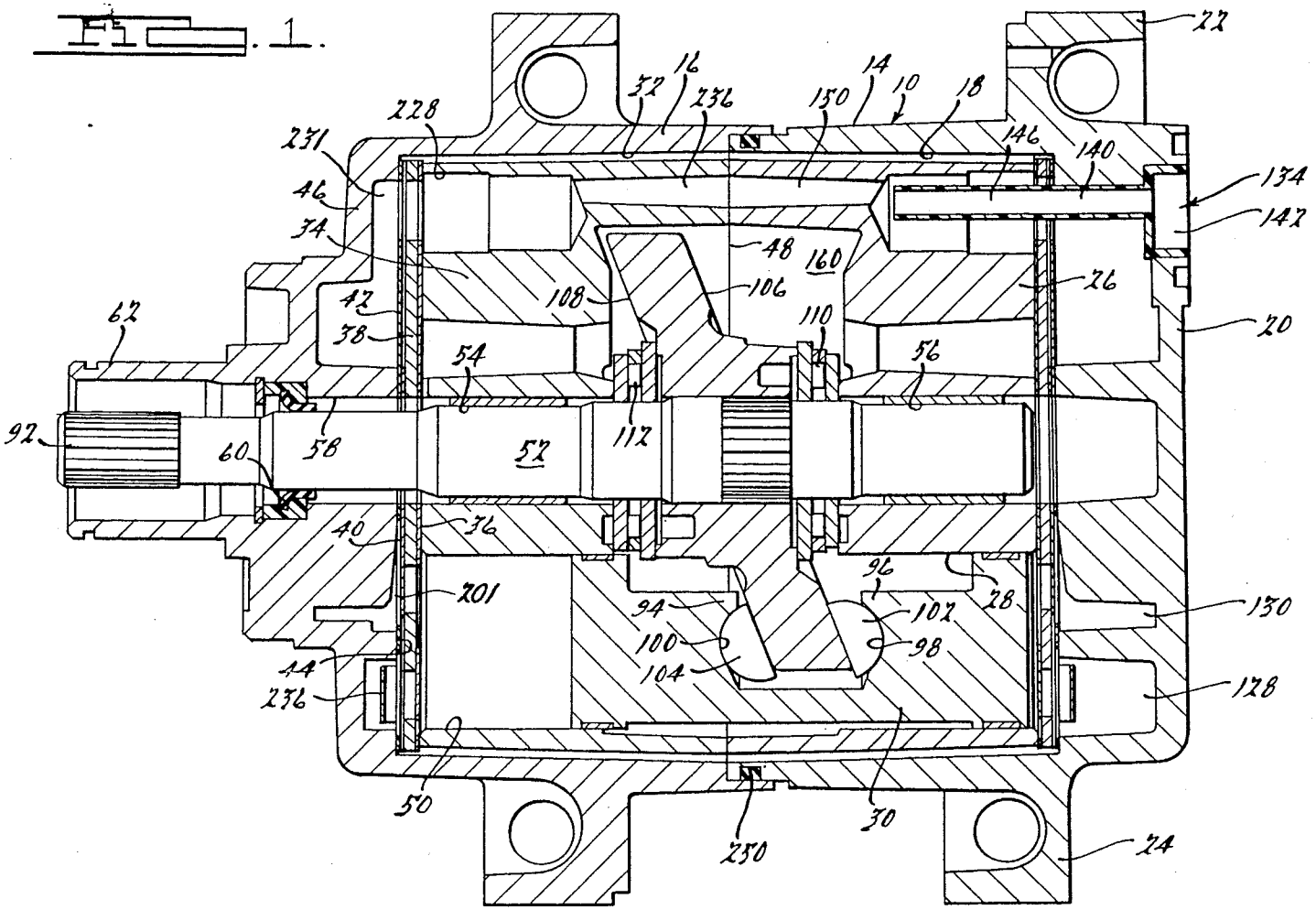
FIG. 1 is a partial radial cross-sectional view of the valve assembly of our invention.

In FIG. 1 reference character 10 designates generally a cast housing for the air conditioning compressor. Numeral 12 in FIG. 1 designates the electromagnetic clutch assembly used with the compressor.

Housing 10 includes a generally cylindrical rear housing part 14 and a generally cylindrical front housing part 16, each of which is formed of die cast aluminum alloy. Housing part 14 has a cylindrical interior 18 and an integral end wall 20 that forms a part of the die casting. Mounting bosses 22 and 24 are formed as part of the die casting, and mounting bolts are received in bolt openings formed in the bosses 22 and 24.

A die cast aluminum cylinder body 26, in which is formed a plurality of cylinder openings, is itself of cylindrical shape and is fitted within the opening 18 with a very small clearance between the inner diameter of the cylindrical opening 26 of the housing 14 and the outer diameter of the cylinder body 26.

One of the cylinder openings in the cylinder body 26 is shown at 28. A compressor piston 30 is slidably received in the cylinder opening 28.

The front compressor head comprises the companion housing part 16. Like the housing part 14, housing part 16 has a circular central opening as seen at 32. A cylinder body 34, which itself is of cylindrical shape, is received in the cylindrical opening 32 with a minimum clearance between its outer diameter and the inside diameter of the cylindrical opening 32.

An inlet valve plate in the form of a circular spring steel disc is identified by reference numeral 36. That disc will be described with reference to FIG. 9. Adjacent the disc 36 is a front valve plate 38, which has formed in it valve openings that are registered with reed valve elements of the inlet valve disc 36. This front valve plate 38 will be described with reference to FIG. 7.

A front discharge valve plate 40, which will be described with reference to FIG. 10, is located directly adjacent valve plate 38. It is formed with reed valve elements that register with valve openings formed in valve plate 38.

A front gasket plate 42 is disposed between the front discharge valve plate 40 and the end surface 44 of the opening 32 formed in the housing part 16. Surface 44 is a machined surface on the inner face of the end wall 46 defining a head of the housing part 16.

As seen in FIG. 1, the cylinder block 30 is assembled in abutting relationship with respect to the cylinder block 34, the abutting surfaces being identified by common reference numeral 48. As seen in FIG. 1, cylinder opening 28 is aligned with cylinder opening 50 in cylinder block 34 thus forming a common cylinder for the reciprocating piston 30.

A swashplate shaft 52 is journalled by bushing 54 in cylinder block 34 and by bushing 56 in cylinder block 26. Shaft 52 extends through end plate opening 58 in the end plate 46. A fluid seal 60 seals the interior of the housing as the shaft 52 rotates in shaft opening 58.

A stationary sleeve shaft extension 62 is formed on the end plate 46 and provides a support for an electromagnetic clutch, not shown.

Figure 6:
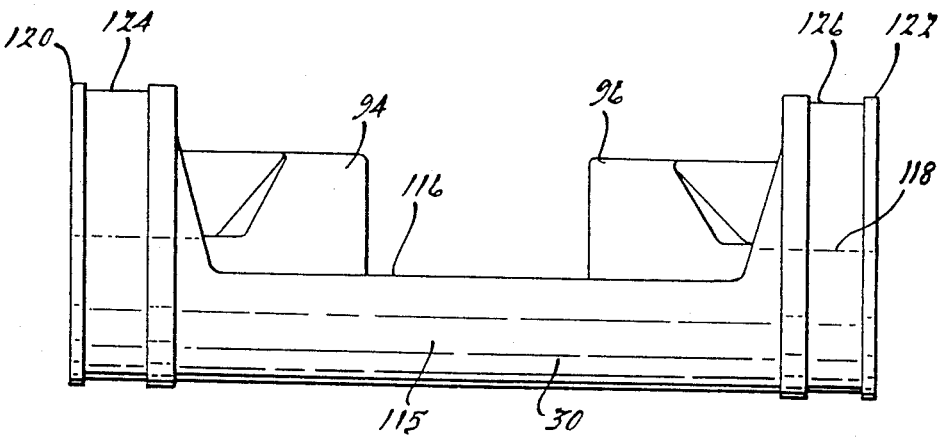
FIG. 6 is a side view of a piston adapted to be received in a cylinder of the cylinder block of FIGS. 2 and 3.

As seen in FIG. 1 and in FIG. 6, the piston comprises two juxtaposed bosses 94 and 96, which are machined to provide semi-spherical pocket, recesses 100 and 98 for swashplate slippers 104 and 102, respectively. The slippers are provided with a flat bearing surfaces that slidably engage surfaces 106 and 108, respectively, on the swashplate and shaft assembly shown in FIG. 1 and in FIG. 4.

Figure 4:
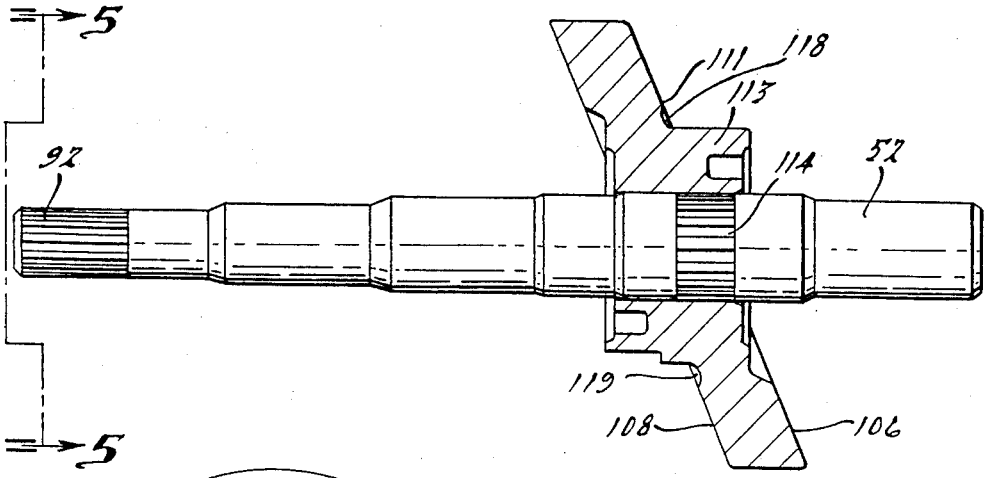
FIG. 4 is a side elevation view of a swashplate and shaft assembly which forms a part of the assembly of FIG. 1.
Figure 5:
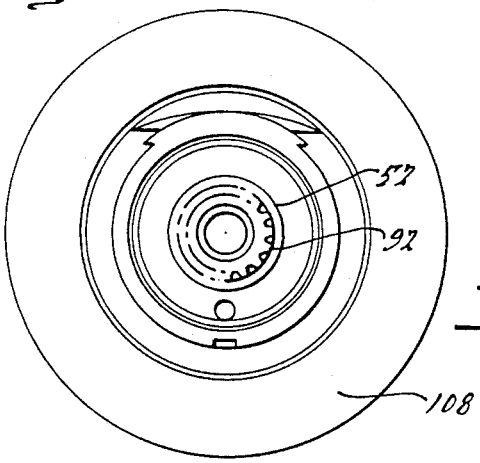
FIG. 5 is an end view of the structure of FIG. 4 as seen from the plane of section line 5—5 of FIG. 4.

The swashplate is disposed as seen best in FIG. 4, at an angle relative to the axis of the shaft. The swashplate itself, which is designated by reference character 111, includes a hub 113 that is press fitted on the shaft 52 and that is locked in place by serrations 114 formed on the shaft 52 prior to the assembly of the swashplate 111 on the shaft by the press fitting operation. As the shaft 52 rotates, the swashplate 106, due to the sliding engagement with the slippers 102 and 104, causes the piston 30 to reciprocate in the cylinder defined by cylindrical openings 28 and 50 in the cylinder blocks 26 and 34, respectively. Thrust forces on the swashplate are accommodated by the radial needle bearing assemblies 110 and 112, which respectively engage the cylinder blocks 26 and 34 whereby the thrust on the swashplate hub is absorbed by the cylinder blocks.

The slippers 102 and 104 are formed of sintered metal, and the flat bearing surfaces are porous enough to carry a lubricating oil film thus establishing a nonabrasive sliding bearing relationship with respect to the surfaces 106 and 108 as the Pistons are reciprocated.

As best seen in FIG. 6, the piston 30 is formed of a unitary die casting. It includes a bridge portion 115 of reduced depth with respect to the diameter of the ends of the piston. The bridge portion is formed during the die casting operation with an upper surface 116 that is situated below the centerline 118 of the piston. This permits sufficient clearance for the outer margin of the swashplate 111 thereby preventing interference during operation of the compressor. This die casting operation eliminates complex machining operations that are heretofore were needed to form reciprocating pistons of swashplate compressors of the kind illustrated in the prior art disclosures mentioned in the specification.

As seen in FIG. 6, the piston is a double acting piston and it is provided with piston ends 120 and 122 of equal diameter. Each end 120 and 122 has a piston seal groove 124 and 126 which receives a piston seal ring.

Figure 11:
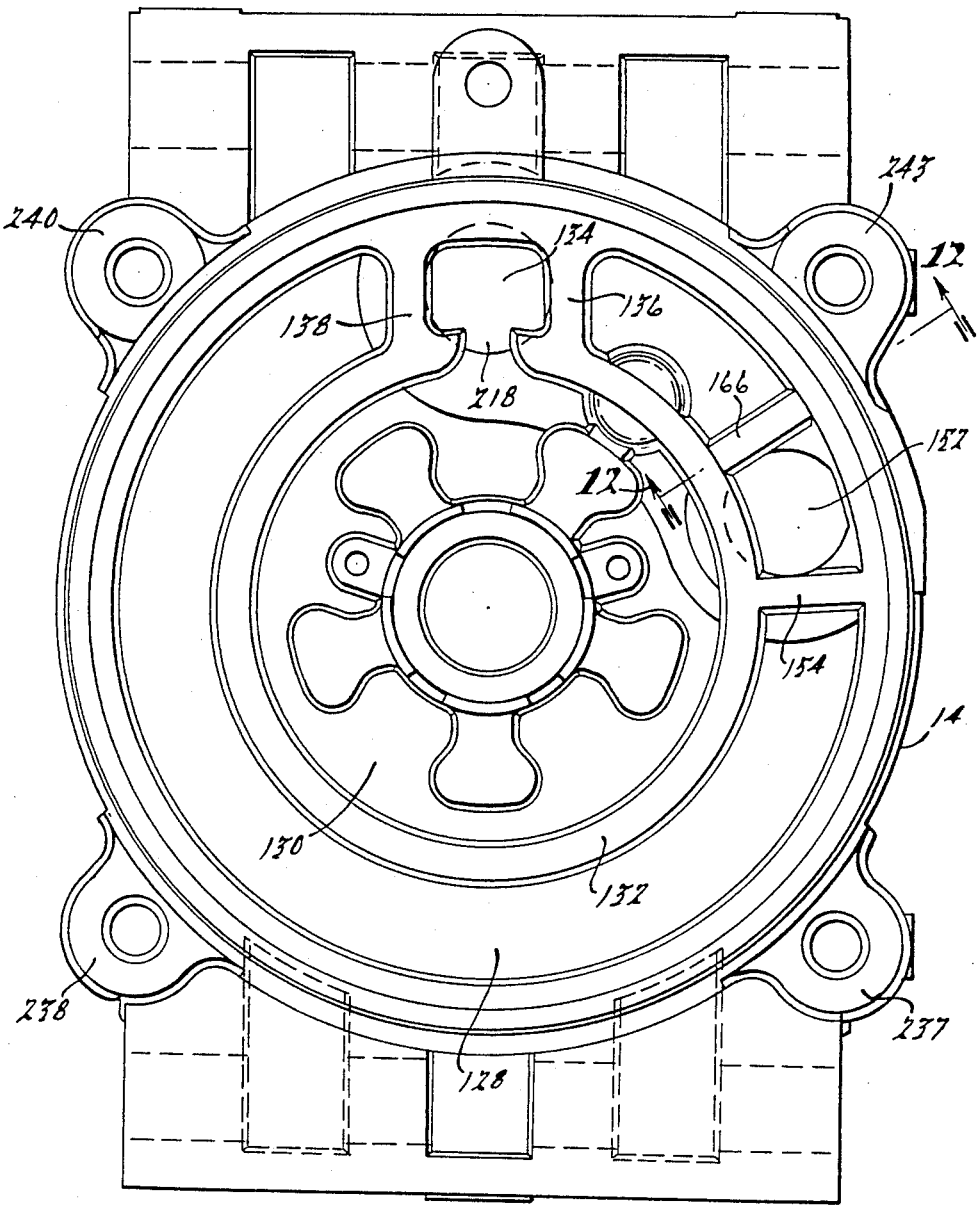
FIG. 11 is an end view of the rear casting head or housing for the assembly. It shows the interior porting and passage arrangement at the end wall of the opening in the casting head.

The rear housing part wall 20 of the housing part 14 has inlet and outlet pressure cavities that are formed in it during the die casting operation. The low pressure inlet cavity shown at 128 encircles the shaft 52 as best seen at numeral 128. It is separated from the high pressure passage 130 by a cylindrical baffle 132. The outlet port, which is a high pressure discharge port, is shown in FIGS. 1 and 11 by reference numeral 134. The upper extremity of the cylindrical baffle wall 132, as seen in FIG. 11, registers with and forms a continuation of separater walls 136 and 138 which isolate the outlet passage from the inlet passage 128. Located in the outlet opening 134 is a pulsation damper tube or muffler, preferably made of plastic material. This is indicated in FIG. 1 by reference numeral 140. It includes a cylindrical end piece 142 received in the discharge opening 134. It includes also a reduced diameter extension 146 that is received in the high pressure cavity 130. The left hand end of the extension 146, as seen in FIG. 1, is received in discharge passage 150 of the rear cylinder block 26. This is seen best by referring to FIG. 2.

When high pressure discharge gases are distributed to the discharge port 150 of the cylinder block 26, those gases pass into the discharge passage 130 formed in the die cast end plate of the housing part 14. But before they can be transferred to the discharge opening 134 they must reverse their flow direction toward the left hand opening of the extension 146 of the damper 140. The flow passage in the extension 146 is of less area than the flow area of the opening 134. This circuitous flow path for the discharge gases results in a dampening of undesirable pressure pulsations in the delivery of the refrigerant.

In FIG. 11 the inlet opening for the refrigerant is shown at 152. It should be noted in FIG. 11 that communication between opening 152 and the arcuate region of the inlet passage 128 is interrupted by a bridge 154. The plane of the inner surface of the bridge 154 is common to the plane of the inner surface of the baffle wall 132. Gases that enter the port 152, therefore, pass directly through openings 156 in reed valve plate 36 as seen in FIG. 9.

Figure 2:
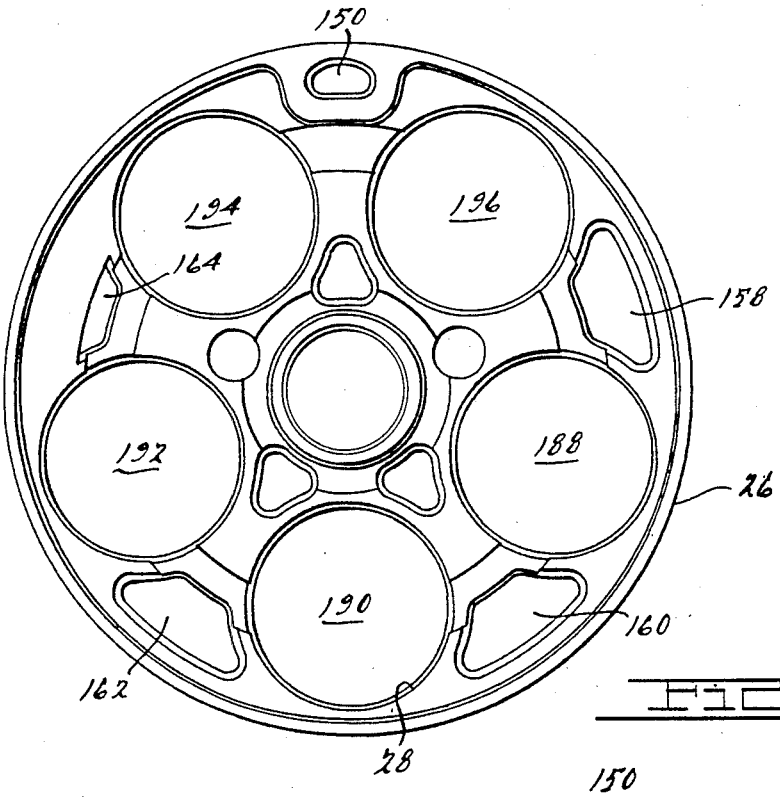
FIG. 2 is an end view of one of the two cylinder blocks that form a part of the assembly of FIG. 1.

The low pressure refrigerant then passes through opening 158 of the rear valve plate 38 shown in FIG. 7. The refrigerant gas then is passed through openings 158 that are cast in the cylinder body 26 as seen in FIG. 2.

The gases then accumulate in the region 160. From there the refrigerant gases pass into each of the other cast low pressure passages 162 and 164 as seen in FIG. 2. The right hand end of each of these cast passages seen in FIG. 2 communicates with the low pressure passage 128 that is cast in the end wall 20 of the housing part 14, as previously described.

As seen in FIG. 11 there is a second bridge 166 which bridges the baffle wall 132 with the outer housing wall. The inner surface of this bridge 166 is lower relative to the base of the inlet passage 128 than the machined surface of the bridge 154. Thus direct communication is permitted between opening 152 and opening 168 formed in the valve plate of FIG. 7.

The valve reed disc of FIG. 9 includes a flexible cantilever valve part 170 which registers with the opening 168 and permits one-way flow through the opening 168 when the piston for the associated cylinder adjacent to it undertakes its intake stroke. The bridge 168 acts as a partial baffle that prevents transfer of a so-called slug of refrigerant in liquid form into the adjacent cylinder and permits relative equal distribution of refrigerant to each of the other cylinders. It does this by assuring that most of the refrigerant, perhaps 80 percent of the inlet flow, is transferred to the cavity 160 and distributed from there through the internal flow intake passages 162 and 164 and 158 from which it is transferred to the cast intake passage 128 formed in the end plate 20 of the housing portion 14.

As seen in FIG. 9, there are multiple cantilever valve elements at 176 and 178 as well as at 170. These valve elements or reeds register with valve plate openings 180, 182, 184, and 186 as well as with opening 158. The cylinder block 26, as seen from FIG. 2, has five cylinder openings which accommodate five compressor pistons and each cylinder is served by a separate one of the valve reeds shown in FIG. 9. As each piston 130 is stroked in a left hand direction as seen in FIG. 1, refrigerant is drawn through the valve plate opening and past its associated valve reed. Refrigerant is then drawn from the opening 128 in the case of cylinders 188, 190, 192 and 194 which are identified in FIG. 2. In the case of cylinder 196 shown in FIG. 2, refrigerant is drawn directly from the opening 152 across the bridge 168.

Figure 12:
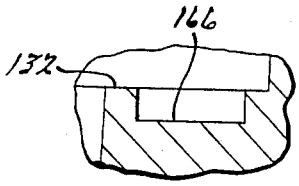
FIG. 12 is a sectional view taken along the plane of section line 12—12 of FIG. 11.

The discharge reed assembly of FIG. 10 includes a plurality of reed valve elements separately identified by reference characters 198, 200, 202, 204, and 206. Each of these valve elements registers with high pressure discharge openings 208, 210, 212, 214, and 216, as seen in FIG. 9. Each of these openings serves as a discharge port for the high pressure refrigerant as the pistons for the respective cylinders are stroked in a right hand direction, as seen in FIG. 1B. The discharge reeds shown in FIG. 12 permit one-way flow of high pressure gases into the discharge flow path 130 previously described with reference to FIG. 13. A baffle wall 132 is separated at 218 to permit communication between passage 130 and the discharge passage 134.

Figure 13:
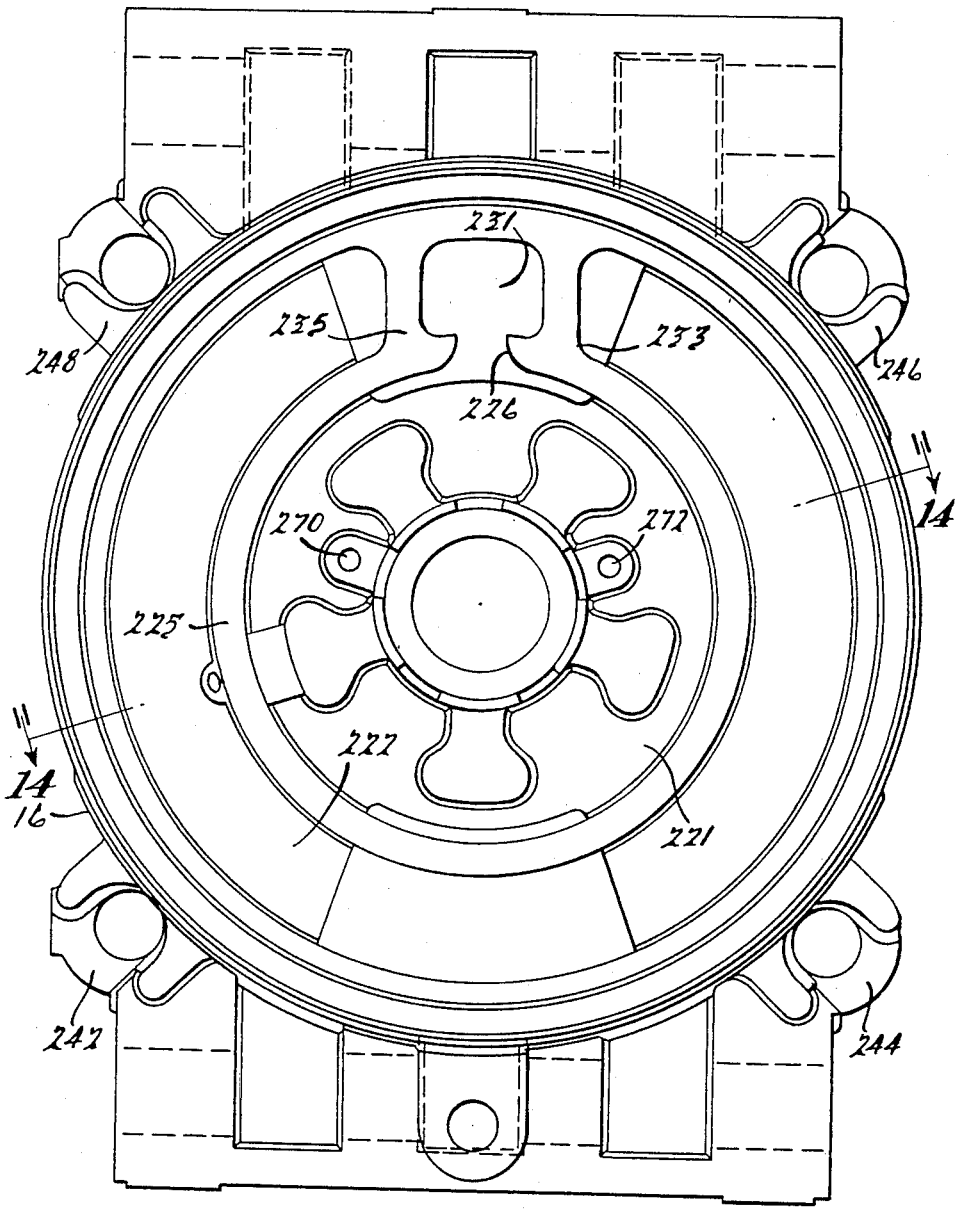
FIG. 13 is an end view of the front casting head of the housing showing the interior of the end wall of the front head together with the porting and passage structure.

The cylinder block 34 is identical and interchangeable with cylinder block 26. The valve plate, the inlet reeds and the discharge reeds described with reference to the rear housing part 14 are identical to those that function with respect to the front housing part 16. Like the rear housing part 14, the front housing part 16 shown in FIG. 13 is provided with cast high pressure and low pressure passages. The high pressure passage shown at 220 corresponds to high pressure passage 130 of the rear housing part of FIG. 11. Low pressure passage 222 of FIG. 13 corresponds to low pressure passage 128 of the rear housing part.

A baffle wall 225, which corresponds to the baffle wall 132 of the rear housing part 14, separates passages 220 and 222. The wall 225 is discontinuous as shown at 226 to provide communication between passage 220 and the outlet opening 228 as seen in FIG. 1. The region 230, seen in FIG. 1B and in FIG. 12, which is the high pressure region, is separated from the low pressure inlet passage 222 by bridge portions 234 and 235 of the baffle wall 225.

Fluid that is discharged by the pumping pistons passes from discharge passage 220 and into the region 231, whereupon it passes through internal crossover passage 236 seen only in FIG. 1. This passage corresponds to passage 150 that was described with reference to the rear cylinder block of FIG. 2. Passage 150 and passage 236 register at their juncture to form a continuous passage that communicates with the discharge opening 142 seen in FIG. 1. This internal crossover passage eliminates the need for providing a separate crossover tube as in some prior art arrangements, and it may be formed during the die casting operation with minimal finish machining operations being required.

Figure 15:
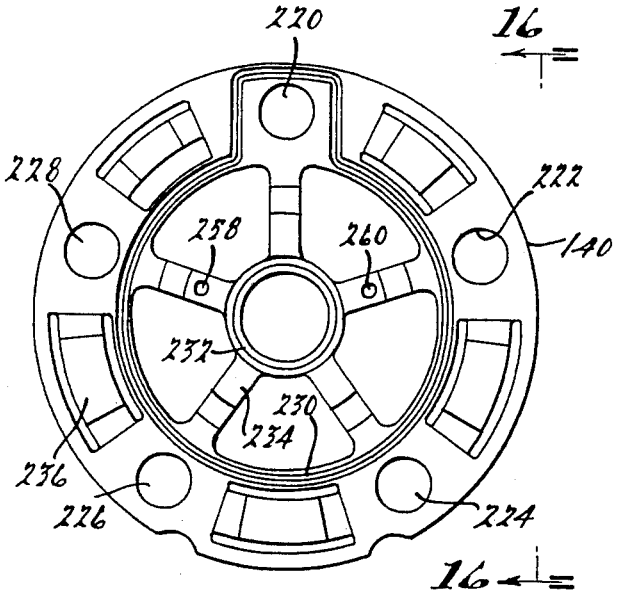
FIG. 15 is a plan view of the gasket for the discharge reed valve and valve plate at each end of the cylinder blocks.

I have shown in FIG. 15 a gasket or seal plate that is interposed between the valve plate and the inner machined surface of the front and rear housing parts. The gasket of FIG. 15, which was described with reference to FIG. 1 and identified by reference numeral 40, includes an opening 220 which communicates with a high pressure opening 188 in the valve plate of FIG. 7. It includes also openings 222, 224, 226, and 228 which register with cast end openings in the front cylinder block, which in turn correspond to the cast end openings previously described with reference to the cylinder block 26 shown in FIG. 2. These respectively are shown in FIG. 2 at 150, 158, 160, 162 and 164.

FIG. 13 shows at 231 an elongated embossment which encircles the axis of the shaft 52 and which envelopes the opening 220. The elongated embossment forms a continuous ridge adjacent the valve plate which registers with the machined inner surface of the baffle wall 225, as shown in FIG. 13. It registers also with the machined surface of the bridge portions 223 and 235 of the baffle wall 225. Thus the elongated embossment forms an effective seal that isolates the high pressure cast passage 220, from the low pressure cast passage 222. The gasket or seal of FIG. 15 includes also an inner elongated embossment ring 232 which prevents passage of high pressure refrigerant from the high pressure discharge port for the cylinders from the region of the bearing 54 and the shaft opening 58. It also secures the reed valve elements of the discharge valve thus preventing overstressing of those valve elements.

Figure 14:
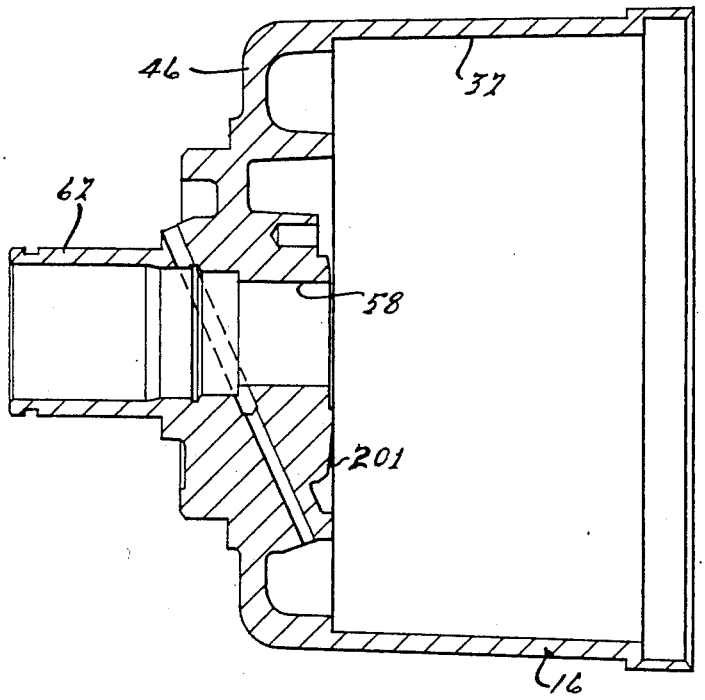
FIG. 14 is a sectional view taken along the plane of section line 14—14 of FIG. 13.

The machined inner surface of the cast housing head 16 shown in FIG. 1 has sloping surfaces 201 as seen in FIGS. 1 and 14. One such surface is provided for each discharge valve reed thus limiting the movement of each valve reed and preventing overstressing. Further, the sloping surface is effective to increase the discharge flow area of each discharge port.

A similar gasket or seal plate is used to seal the high pressure and low pressure passages in the end wall 20 of the rear housing part 14.

The valve plate for the front cylinder block is identical to the valve plate for the rear cylinder block. Similarly, the inlet valve reeds and the discharge valve reeds for the front and rear cylinder blocks are identical, one with respect to the other. This interchangeability, as well as the interchangeability of the cylinder blocks themselves, simplifies both the design and the manufacture and assembly of the components, thus making it possible to achieve reduced manufacturing costs and improved reliability during operation following assembly.

Radial arms, one of which is shown at 234 in FIG. 15, support the hub of the gasket on which the embossment 232 is formed.

Figure 16:
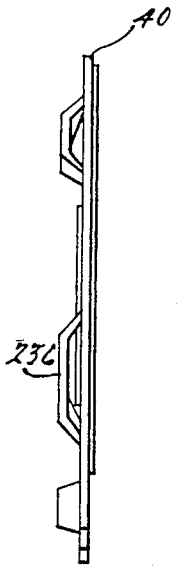
FIG. 16 is an edge or end view of the gasket as seen from the plane of section line 16—16 of FIG. 15.

Near the radially outer margin of the gasket of FIG. 16 are straps 236 which provide rigidity to the disc but which are displaced out of the plane of the gasket thereby permitting free flow of refrigerant gas through the valve plate openings and past the inlet valve reeds. The relative position of the straps 236 with respect to the plane of the gasket can be seen by referring to FIG. 1 where the gasket is shown in cross section.

As seen in FIG. 11 the rear housing part 14 has four external bosses 237, 238, 240, and 243. Similarly, the front housing part 16 has bosses 243, 244, 246 and 248, which register with the bosses 237, 238, 240, and 243 of the front housing part 16. Each of these bosses has a bolt opening to permit entry of a clamping bolt. When the bolts are tightened following assembly of the components, the cylinder blocks are brought into registry, one with respect to the other, and a predetermined load is applied to the gasket. Effective seals thus are established. The left hand margin of the housing part 14 is received within the right hand margin of the housing part 16, as seen in FIG. 1, and an "O" ring seal 250, which is received in an "O" ring groove in the housing part 14, establishes a fluid tight seal between the mating parts.

The previously mentioned slipper shoes that engage the surfaces 106 and 108 of the swashplate are formed of powdered metal that may be heat treated to a hardness of over 40 Rockwell C. It is possible, therefore, to eliminate the necessity for using a separate shoe on the movable slipper element as in prior art designs such as those shown in the prior art references mentioned in the preceding portion of this specification. Only the slide bearing surfaces need be finished by grinding or by lapping. The shoes themselves may or may not be tumbled after they are finished. In addition to the interchangeability of the parts—for example, the inlet valve disc, the discharge valve disc and the valve plate—, preassembly of the valve plate with the gasket and the two reed valve discs can be achieved by locater pins which are received in pin openings formed in valve Plate 38 illustrated in FIG. 7. These pins are received with a force fit in pin openings 254 and 256 as seen in FIG. 7. Corresponding openings 258 and 260 are formed in the discharge valve of FIG. 10, and these register with the locater pins. Similarly, locater pin openings 258 and 260 are formed in the gasket as formed in FIG. 15, and these also register with the locater pins.

Figure 3:
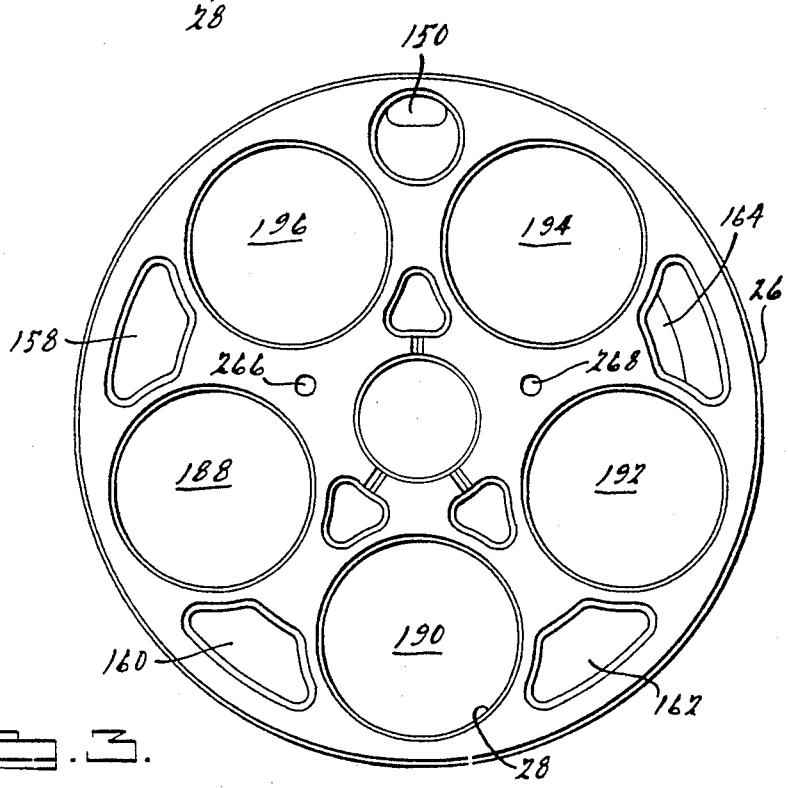
FIG. 3 is an end view showing the opposite end of the cylinder block of FIG. 2.

On the opposite side of the valve plate pin openings 262 and 264, as seen in FIG. 9, register with the valve pins. Thus the valve plate, the inlet valve disc, the discharge valve disc, and the gasket can be preassembled to simplify the manufacturing operation. After this preassembly procedure the subassembly is inserted into registering pin locater openings 266 and 268, shown in FIG. 3 for the rear housing part. Corresponding pin openings 270 and 272 for the front housing part can be seen in FIG. 12. These locater pins establish proper angular registry of the assembled parts, one with respect to the other. No fasteners are required and the manufacturing cost and assembly cost and improved reliability by a simplified assembly is achieved.

Manufacturing operations are simplified further by the piston construction as explained previously. The piston construction has a bridge area that does not require finish machining. The bridge area is formed during the die casting operation and it permits the swashplate outside diameter at maximum displacement to extend beyond the bosses for the slippers. There is no need for machining a relief area in the bridge surface as in the prior art constructions, examples of which are shown in the references described in this specification. It is permissible with this design for the swashplate to engage the bridge surface with a running engagement on the midpoint surfaces of the bridge.

The improved design further provides improved reliability and simplified manufacturing operations by reason of the die casting process for forming the swashplate itself. It is normal practice in the design of a swashplate compressor to use a cast forge process or to use a forging process without casting. The depth between the face of the shoe and the hub of the swashplate is sufficiently reduced in our design to assure sufficient strength. The presence of the refrigerant in the region of the swashplate provides sufficient lubrication because lubricating oil is present. Thus the refrigerant gas permits an oil film to be developed continuously over which the slippers may act.

The bearings 54 and 56 for the shaft 52 are steel backed sleeve bearings which can be assembled with no further machining being required after installation. These are located, as seen in FIG. 1, adjacent radial needle bearings 112 and 110 respectively. The cage for the radial rollers of the bearings 112 and 110 rotate in the usual fashion between two thrust washer rings. This establishes a centrifugal pumping action which draws lubricant and refrigerant from the inboard ends of the sleeve bearings. A pressure differential exists between the swashplate chamber and the inlet annulus that is cast in each of the end plates for the housing parts. The existence of this pressure differential creates a pressure differential across the bearings themselves and this is aided by the centrifugal action of the rotating cages of the radial needle bearings, which act as thrust bearings. Thus the cages of the radial needle bearings, which act as thrust bearings, and the journal bearings are lubricated thereby further improving the reliability of the compressor.

Having described a preferred embodiment of my invention, what we claim and desire to secure by U.S. Letters Patents is:

1. In an air conditioning compressor having two cast housing heads that form parts of a cylinder housing, said housing enclosing cylinder blocks with axial cylinders formed therein;

said air conditioning compressor comprising two cast generally cylindrical parts that form a bipartite compressor housing, each housing part having an end wall forming a housing head and a generally cylindrical portion, the generally cylindrical portions of said housing parts being joined in end-to-end juxtaposed relationship at a location intermediate the housing heads for said housing parts;

means for clamping said housing parts together with a force that is axially directed with respect to the housing axis;

a cylinder block in each housing part defining axially disposed cylinders, the cylinder block for one housing part abutting the cylinder block for the other housing part in axially aligned, juxtaposed relationship whereby the cylinders of one block form continuations of the cylinders for the other block, thus defining common cylinder openings;

a double-acting piston in each cylinder opening; a swashplate and driveshaft assembly having a swashplate drivably engageable with each piston and a driveshaft mounted in each cylinder block coaxially therewith;

a valve assembly having a valve plate with refrigerant delivery and supply ports therein located between each housing head and an adjacent surface of a cylinder block;

each cylinder block having formed therein high pressure and low pressure flow passages that communicate with each cylinder of the adjacent cylinder block;

flat radial surfaces on each housing head;

an inlet valve disc between each valve plate and the adjacent surface of a cylinder block including valve reeds that provide controlled flow from said low pressure passages to said cylinders;

a discharge valve disc located between said radial surfaces and said valve plate including discharge valve reeds that provide controlled flow from said cylinders to said high pressure passages; and a seal plate between said valve plate and said radial surfaces including porting for accommodating axial flow of high pressure fluid and low pressure fluid;

said clamping means applying a sealing and retaining force on said cylinder blocks, said valve disc, said valve plate and said seal plate.

2. The combination as set forth in claim 1 wherein said valve assembly has locater pins secured to and extending axially from said valve plate;

said discharge valve disc, said seal plate and said inlet valve disc having locater openings that receive said pins;

said pins being retaining said discharge valve disc, said seal plate and said inlet valve disc in assembled relationship and in predetermined angular relative registry as a subassembly; and locater openings in said cylinder heads adjacent each valving assembly receiving said locater pins thereby establishing a predetermined angular relative registry of each subassembly with respect to said cylinder blocks.

3. The combination as set forth in claim 1 wherein said seal plate has an elongated embossment that surrounds said discharge valve disc and thereby separates high pressure fluid from low pressure fluid.

4. The combination as set forth in claim 3 wherein said seal plate has a second elongated embossment at a radially inward part of said discharge valve disc and secures said discharge valve disc against said valve plate without establishing high stress at the bases of the discharge valve reeds.

5. The combination as set forth in claim 2 wherein said seal plate has an elongated embossment that surrounds said discharge valve disc and thereby separates high pressure fluid from low pressure fluid.

6. The combination as set forth in claim 5, wherein said seal plate has a second elongated embossment at a radially inward part of said discharge valve disc and secures said discharge valve disc against said valve plate without establishing high stress at the bases of the discharge valve reeds.

* * * * *